US005447369A

United States Patent [19]

Boxall

[11] Patent Number: 5,447,369

[45] Date of Patent: Sep. 5, 1995

[54] INDUSTRIAL MIXER

[76] Inventor: Russell E. Boxall, 12 Boonah Avenue, Pagewood, New South Wales 2036, Australia

[21] Appl. No.: 163,314

[22] Filed: Dec. 8, 1993

[51] Int. Cl.[6] ..... B01F 15/02

[52] U.S. Cl. ..... 366/136; 241/46.11; 241/46.17

[58] Field of Search ..... 366/136, 137, 159, 157; 241/46.11, 46.17, 46.02

[56] References Cited

U.S. PATENT DOCUMENTS

| | | | |
|---|---|---|---|
| 3,640,474 | 2/1972 | Niedl | 241/46.02 |
| 3,704,865 | 12/1972 | Kharitonov | 366/137 |
| 4,904,089 | 2/1990 | Dunton | 366/137 |
| 5,188,808 | 2/1993 | Lilja | 366/320 |

*Primary Examiner*—Robert W. Jenkins
*Attorney, Agent, or Firm*—James Ray & Associates

[57] ABSTRACT

Industrial apparatus for mixing viscous material comprising a stationary mixing tank (1) having an inlet (7) and an outlet (8), a rotary stirring element (12) within the tank, duct means (23) interconnecting said outlet (8) and inlet (7), and an impeller (18) mounted for rotation with said stirring element (12), to thereby urge said viscous material towards said outlet (8) to at least assist the flow of material from said outlet through said duct means (23) to said inlet (7) and its recirculation through said tank (1). A macerating pump (29) is interposed along said duct means (23) to assist with mixing and recirculation.

15 Claims, 1 Drawing Sheet

INDUSTRIAL MIXER

BACKGROUND OF THE INVENTION

1. Field of The Invention

The present invention relates to apparatus for mixing viscous and/or thixotropic materials, and, in particular, to such apparatus for use in industrial processes.

2. Description of The Prior Art

Conventionally, industrial mixers for paint, putty and other viscous and thixotropic materials have taken various forms, but generally comprise a receptacle adapted to hold the material to be mixed, and stirring devices. The receptacle is fixed or rotated and the stirring devices comprise paddles on rotors. In other forms, conventional mixers have included shaking, oscillating or vibrating mechanisms.

Typically, a quantity of unmixed viscous material is deposited in a receptacle and mixed therein until a satisfactory mixed material is produced. Consistency in homogeneity and texture has proved difficult to achieve and in the case of pasty material, the contents of the receptacle have at times proven difficult to dispense.

SUMMARY OF THE INVENTION

An object of the present invention is to provide an improved mixing apparatus which will reduce processing time or alleviate at least one of the above-mentioned disadvantages.

In accordance with one aspect the present invention provides apparatus for mixing viscous material comprising a mixing tank having an inlet and an outlet, a rotary stirring element within the tank, duct means interconnecting said outlet and inlet, and an impeller mounted for rotation with said stirring element, to thereby urge said viscous material towards said outlet to at least assist the flow of material from said outlet through said duct means to said inlet and its recirculation through said tank.

Preferably the tank may include a curved inner wall portion, and the impeller may include a member having a diameter such that all points on its periphery travel in circles substantially conforming to said curved wall portion.

Preferably the downstream or lower portion of the tank may be in the shape of a funnel, and said impeller may rotate within said funnel-shaped portion.

More preferably said duct means may include a anacerating-pump therealong.

BRIEF DESCRIPTION OF THE DRAWINGS

One embodiment of the present invention will now be described with reference to the accompanying drawings, in which:-

DESCRIPTION OF THE PREFERRED EMBODIMENT

Figures 1, 2, 3, 4:
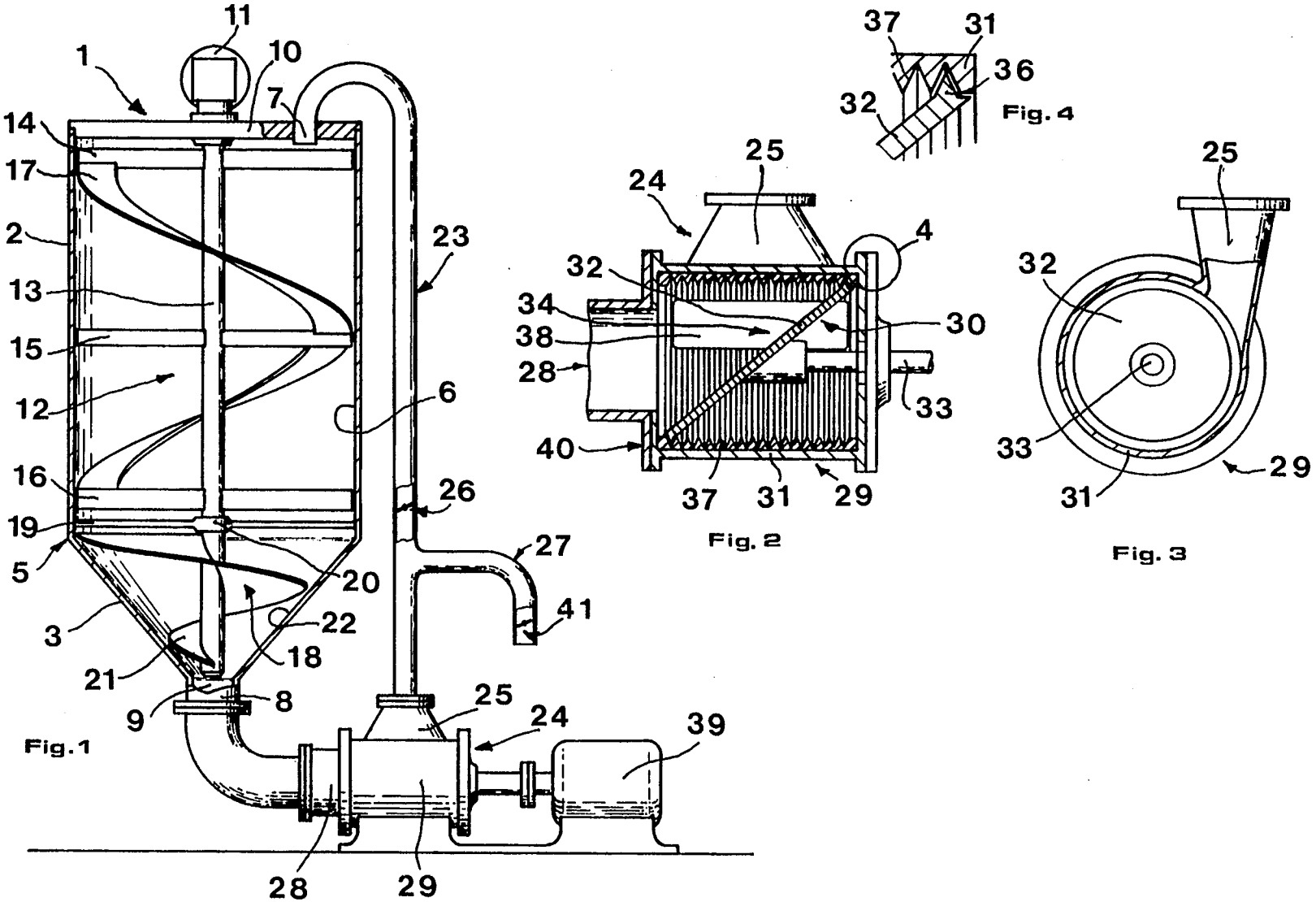
FIG. 1 is a side elevation view of a mixing apparatus according to the invention.
FIG. 2 is a cross-sectional view of a macerating pump.
FIG. 3 is a part-sectional end view of the pump of FIG. 2.
FIG. 4 is a scrap section corresponding to that part of FIG. 2 within the enclosure marked 4 in that figure, drawn to a larger scale.

The illustrated mixing apparatus comprises a mixing tank 1 comprising a housing having a vertically oriented, substantially cylindrical portion 2, and an integral vertically oriented, substantially funnel-shaped portion 3 disposed below the cylindrical portion 2. The inner diameter of the mouth 5 of the funnel-shaped portion coincides with the inner diameter 6 of the cylindrical portion, their inner walls being contiguous.

The mixing tank has an inlet 7 at the top of the tank, and an outlet 8 at the bottom of the tank. The throat 9 of the funnel constitutes said outlet 8.

The mixing tank 1 includes an open top with a cover (not shown) and support member 10 adapted to support a variable speed motor 11.

The mixing tank 1 includes therein a rotary stirring element 12 comprising a vertical shaft 13 with a plurality, say three, of paddles 14, 15 and 16 attached thereto and a helical band 17. The helical band 17 is attached along its length to each paddle at or near their respective radially outer ends. The helical band 17 is of a hand to urge the contents of the tank downwardly upon rotation of shaft 13. The shaft 13 is rotatably mounted coaxial with the cylindrical axis of the tank. The shaft 13 protrudes into the funnel-shaped housing 3, and has an impeller 18 mounted for rotation with said stirring element 12. The end of the shaft above the paddles is mounted at the top of the tank and connected to the variable speed motor 11. A bridging element 19 and bearing 20 is disposed below the paddles to support the shaft 12 coaxial with the cylindrical axis of the housing 2.

Said impeller 18 comprises a spiral member 21 extending from the shaft 13. The diameter of the spiral member 21 is such that all points on the periphery of the member 21 travel in circles substantially conforming to the inner wall 22 of the funnel-shaped portion 3 of housing 2. The spiral member 21 of the impeller 18 is of a hand to urge material in the tank downwardly towards the outlet 8 upon rotation of shaft 12.

The apparatus also includes a duct 23 which interconnects the outlet 8 of the tank disposed at the bottom of the tank to the inlet 7 of the tank disposed at the top of the tank. The impeller 18 urges the viscous material in the tank downwardly towards the outlet 8, to at least assist the flow of material from said outlet 8 through the duct 23 to said inlet 7, and to assist in the circulation and recirculation through said tank of the mixed viscous material.

The spiral member 21 of the impeller 18 is of a hand and cooperates with the inner wall 22 of the funnel-shaped portion 3 of the housing 2 to more positively urge the material downwardly in the funnel-shaped portion towards the throat 9, and subsequently through said duct 23 to recirculate the material into the tank. It also works the material and assists in dispensing the contents of the tank at the completion of mixing.

A macerating pump 24 is located between the ends of the duct 23. A cut-off valve 26 adapted to regulate the delivery of worked material to the top of the tank is interposed between the outlet port 25 of pump 24 and the inlet 7 of the tank along said duct 23. A discharge pipe 27 is interposed between the outlet port 25 of the pump 24 and the cut-off valve 26 to enable the final worked material to be discharged. The discharge pipe 27 includes a cut-off valve 41 therealong to control discharge therethrough. The pump 24 not only assists to drive the material through the duct 23, but also disperses, macerates, and otherwise works the material passing therethrough to assist in producing a homogeneous mixture.

The pump 24 comprising an inlet port 28, an outlet port 25, a pump housing 29 and an elliptical impeller 30, is coupled to an electric motor 39 which drives the elliptical impeller 30 inside the housing 29 of the pump 24. The housing 29 is a cylindrical casing 31, the elliptical impeller 30 comprises an elliptical plate 32 attached to a motor-driven shaft 33. The face 34 of the elliptical plate 32 is disposed at an inclined angle to the longitudinal axis of the shaft 33. The peripheral edge 35 of the plate 32 includes teeth 36 which mesh with circular circumferential grooves 37 in the casing 31. The teeth 36 mesh loosely with the grooves 37 in order to permit material to enter and be worked therebetween. The elliptical impeller 30 also spins the material in the casing and urges it up towards the outlet port 25 of the pump 24, through the duct 23, and into the top 7 of the tank. The outlet port 25 includes a rectangular opening 38 in the side wall of the casing 31. The rectangular opening 38 is longitudinally disposed along the longitudinal axis of the casing 31. The inlet port 28 is disposed in the end face 40 of the casing 31 remote from the motor driven shaft 33.

In operation, the tank cover is removed and a quantity of the viscous thixotropic material is deposited into the open top of the tank. During mixing the cut-off valves 26 and 41 are set to recirculate material back into the tank. Motors 11 and 39 are switched on. Motor 11 rotates shaft 13, paddles 14, 15 and 16, helical band 17 and impeller 18, thereby stirring the contents. The spiral member 21 cooperates with the inner wall 22 of the funnel-shaped portion 3 of the housing to urge the material towards the outlet 8. The material is thereby mixed in a vortex or swirling motion in the conic section of the funnel-shaped portion 3 of the housing, and the material is forced into the throat 9 of the funnel-shaped portion 3 of the housing and into pump 29. The elliptical impeller 30, rotated by motor 39, macerates and disperses the material therein and pushes it through pump outlet 25, into duct 23, and back into the top of the tank through inlet 7, thereby recirculating worked material. The mixing tank 1 and the pump 29 mechanically mix and reduce the material in the tank and work that material to produce the requisite mixed product.

The material is continuously recirculated through the mixing tank 1 and through the pump 29 a number of times to produce a mixture of required homogeneity and texture, the number depending, inter alia, upon the nature and character of the material. The macerating pump 29 breaks up the material to form a smooth textured paste and assists in dispensing the contents of the tank at the completion of mixing. The pump 25 performs a mixing, macerating and pumping action.

When the material is thoroughly mixed the cut-off valves 26 and 41 are set so that the mixed material is directed through the discharge pipe 27 and prevented from recirculating to the top of the tank.

Experimental results indicate that processing time may be considerably reduced, and consistency and homogeneity and texture of the finished product may be improved, by the use of this invention. In the case of putty, processing time has been found to be considerably reduced compared to using a conventional mixer.

The foregoing describes only one embodiment of the invention, and modifications obvious to those skilled in the art can be made without departing from the scope of the present invention. For example, the macerating pump may have an inner surface which, instead of including circumferential grooves, may be smooth, or it may comprise a combination of circumferential grooves, transverse grooves or smooth surfaces. Further, the pump may be a gear pump, vane pump or any other pump which will effectively assist in the mixing and recirculation of material to the tank.

I claim:

1. Apparatus for mixing viscous material comprising a mixing tank having an inlet and an outlet, a rotary stirring element within the tank, duct means interconnecting said outlet and inlet, an impeller mounted for rotation with said stirring element, to thereby urge said viscous material towards said outlet to at least assist the flow of material from said outlet through said duct means to said inlet and its recirculation through said tank, and a pump interposed along said duct means to at least assist the flow of material from said outlet through said duct means to said inlet and its recirculation through said tank, said pump having a macerating means therein to at least assist the mixing of said viscous material.

2. Apparatus according to claim 1 wherein the tank includes a curved inner wall portion, and the impeller includes a member having a diameter such that all points on its periphery travel in circles substantially conforming to said curved wall portion.

3. The invention as defined in claim 2 wherein said curved wall portion is conic.

4. Apparatus according to claim 2 wherein said impeller comprises a spiral member.

5. Apparatus according to claim 4 wherein the downstream or lower portion of the tank is in the shape of a funnel, and said impeller rotates within said funnel-shaped portion.

6. Apparatus according to claim 1 wherein said duct means includes valve means to assist in drawing-off mixed material.

7. Apparatus according to claim 1 wherein said rotary stirring element comprises a rotary shaft, paddle means and helical band means attached thereto.

8. Apparatus according to claim 1 wherein said macerating means within said pump comprises an elliptical impeller rotatably mounted in a cylindrical pump casing having an inlet port and an outlet port.

9. Apparatus according to claim 8 wherein said macerating means within said pump includes annular groves in the inner surface of said pump and said elliptical pump impeller includes teeth about its peripheral edge adapted to cooperate with said grooves to macerate material therebetween.

10. A method of producing a homogeneous mixture of viscous materials, said method comprising the steps of:

(a) depositing a volume of viscous materials into a mixing tank;

(b) initiating stirring of said viscous materials disposed in step (a);

(c) withdrawing a volume of said viscous materials from a bottom portion of said tank in a substantially continuous manner;

(d) macerating said viscous material withdrawn in step (c) to assist in the homogenization thereof;

(e) communicating said viscous materials macerated in step (d) back to said tank until a desired consistency, homogeneity and texture of said viscous materials is achieved.

11. A method according to claim 10, wherein said viscous material is thixotropic.

12. A method according to claim 11, wherein said thixotropic material is putty.

13. A method according to claim 10, wherein said method includes the additional steps of:

(a) stopping communication of said viscous material back to said tank; and (b) withdrawing said viscous material from said tank until said tank is empty.

14. A method according to claim 13, wherein said viscous material is thixotropic.

15. A method according to claim 14, wherein said thixotropic material is putty.

* * * * *